US005392911A

United States Patent [19]

Gillispie et al.

[11] Patent Number: 5,392,911

[45] Date of Patent: * Feb. 28, 1995

[54] TWO BARREL HAZARDOUS MATERIAL SPILL SKID

[75] Inventors: John G. Gillispie; Donald J. Mitchell, both of Wellsburg, W. Va.

[73] Assignee: Eagle Manufacturing Company, Wellsburg, W. Va.

[ * ] Notice: The portion of the term of this patent subsequent to Dec. 3, 2011 has been disclaimed.

[21] Appl. No.: 208,942

[22] Filed: Mar. 10, 1994

Related U.S. Application Data

[63] Continuation-in-part of Ser. No. 72,268, Jun. 3, 1993, Pat. No. 5,307,931.

[51] Int. Cl.[6] ..... B65D 19/18

[52] U.S. Cl. ..... 206/386; 108/51.1; 108/56.3; 108/901; 206/600

[58] Field of Search ..... 206/386, 599, 600, 507, 206/512; 108/56.3, 56.1, 51.1, 901, 53.1, 55.1

[56] References Cited

U.S. PATENT DOCUMENTS

| | | | |
|---|---|---|---|
| 2,773,624 | 12/1956 | Knnerem et al. | 206/512 |
| 3,447,715 | 6/1969 | Beney | 206/507 |
| 3,878,796 | 4/1975 | Morrison | 108/901 X |
| 3,917,108 | 11/1975 | Thurman | 108/901 X |
| 4,183,491 | 1/1980 | Sanders et al. | 108/51.1 X |
| 4,838,178 | 6/1989 | Chriske et al. | 108/55.1 |
| 4,930,632 | 6/1990 | Eckert et al. | 206/386 |
| 5,020,667 | 6/1991 | Bush | 206/386 |
| 5,036,976 | 8/1991 | Sechler et al. | 206/386 |
| 5,092,251 | 3/1992 | Hamaker et al. | 108/51.1 |
| 5,147,039 | 9/1992 | Sechler et al. | 206/386 |
| 5,307,931 | 5/1994 | Gillispie et al. | 206/386 |

*Primary Examiner*—Bryon P. Gehman

*Attorney, Agent, or Firm*—Armstrong, Westerman, Hattori, McLeland & Naughton

[57] ABSTRACT

A hazardous material spill skid for use with one or two barrels has a tray with upwardly and outwardly extending side walls and end walls and a bottom wall with an upwardly extending hollow support post. The side and end walls have horizontal flanges with an upper surface coplanar with the upper surface of the support post, and an upwardly extending rim. Preferably, a side wall locking lip is provided on one of the side walls and an end wall locking lip on each end wall to secure a grate to the tray. The grate is preferably a blow molded unit having hollow parallel bars and cross-bars contained within a hollow frame.

10 Claims, 5 Drawing Sheets

TWO BARREL HAZARDOUS MATERIAL SPILL SKID

CROSS-REFERENCE TO RELATED APPLICATION

The present application is a continuation-in-part of application Ser. No. 08/072,268, filed Jun. 3, 1993, now U.S. Pat. No. 5,307,931 in the names of the present inventors and assigned to the assignee of the present invention, entitled "Hazardous Material Spill Skid".

FIELD OF THE INVENTION

The present invention relates to a two barrel or drum hazardous material spill skid and comprises a containment tray for containment of spillage from industrial drums and a support grating supported on the containment tray providing a stable surface for industrial drums.

BACKGROUND OF THE INVENTION

With the ever increasing stringent regulations relative to hazardous materials, users of such materials as organic solvents are required to contain any spillage or leakage from industrial barrels or drums and prevent pollution of underlying substrates and runoff of such materials to soil or water courses.

Examples of hazardous waste spill skids of the prior art are described in U.S. Pat. Nos. 4,838,178, 4,930,632, 5,020,667, 5,036,976, 5,092,251 and 5,147,039. In U.S. Pat. No. 4,838,178, a hazardous waste shipping pallet is shown which is preferably formed as a metal tray with a plywood platform. The shipping pallet has a planar base and a rigid support member fixedly mounted to the bottom surface of a container, and at least one internal load bearing rail fixedly mounted to the uppermost surface of the inside of the container, with a removable platform positioned on the load bearing rail. U.S. Pat. No. 4,930,632 shows a tray having a base and substantially vertical side walls to form a containment pan with the side wall upper edges lying in a common plane, the tray bottom wall having grooves to receive forks of a fork lift and reinforcement ribs between the grooves. A pallet support member rests in the tray and is formed of spaced apart beams and transverse rails attached to the beams to form a platform to support a storage pallet above the plane formed by the upper edges of the tray side walls. In U.S. Pat. No. 5,020,667, a rectangular chamber is formed by a polyethylene bottom and side walls, the side walls having a support ledge at the upper periphery thereof. A fiberglass grating is provided that has spaced bars shaped to direct spilled material into the chamber, and a polyvinyl or polyethylene support tube, preferably removable, is disposed in a central chamber of the rectangular chamber, with apertures in the tube to allow dispersal of spillage to other subchambers. U.S. Pat. No. 5,036,976, which is a continuation of the application which issued as U.S. Pat. No. 4,930,632 has a tray similar to the tray of that earlier patent and a pallet support member which rests in the tray, the pallet support member comprising at least one support member received within the tray and resting on the bottom wall and a platform member supported by the support member to form a platform substantially at the level of the plane formed by the tray side wall upper edges, so as to provide support for a storage pallet adjacent to or above that plane. In U.S. Pat. No. 5,092,667, a rotationally molded integral pallet and platform are described, with a basin beneath the platform, the platform having an undulating cross-section and a plurality of holes passing through the platform to permit leakage from drums supported on the platform to enter the basin. A center post may extend from the bottom wall of the base of the basin to a position adjacent the platform to support the platform at the center thereof. U.S. Pat. No. 5,147,039, which is a continuation of the application from which U.S. Pat. No. 5,036,976 issued, shows a containment tray having a floor and vertical side walls and a removable support structure insertable into the tray and resting on the floor, the removable support comprising a plurality of upright support members resting on the floor and a plurality of members positioned on the support members to form a generally horizontal support platform on which a palletized load of containers may be positioned.

Applicants are also aware of a spill pallet available commercially which has a polyethylene tray with four walls and a central support extending between two opposed walls of the tray and central extensions extending from the central support in the direction of the other two walls. The central support has an upward ridge therealong which divides the tray into two sections, with a solid grate resting in each of the two sections of the unit, on a wall ledge and on the central support, adjacent the upward ridge, and on one of the central extensions.

SUMMARY OF THE INVENTION

A hazardous material spill skid for use with one or two industrial drum of hazardous material has a rectangular tray and a grate. The tray has a bottom wall, upwardly and outwardly extending side walls and end walls, and a hollow center post extending upwardly from the center of the bottom wall. At least a portion of each side wall and end wall terminates as a horizontally outwardly extending flange that has an upper surface in a horizontal plane formed by an upper surface of the hollow center post. The flanges have a vertically upwardly extending rim disposed about the upper ends of the side and end walls, and preferably a side wall locking lip is provided on one side wall and end wall locking lips are provided on the end walls so as to secure the grate in place on the horizontal flanges.

The grate is preferably a blow molded unit having a plurality of hollow parallel bars and hollow parallel cross-bars that are disposed between a hollow frame.

DETAILED DESCRIPTION

In Applicants' earlier application, Ser. No. 08/072,268 filed Jun. 3, 1993, the contents of said application incorporated by reference herein, of which the present application is a continuation-in-part, a hazardous material spill skid is described using a rectangular tray and two blow molded grate members. That hazardous material spill skid was designed for use with one, two, three or four commercial drums or barrels. In some instances, however, a smaller unit for use with a maximum of two drums or barrels, or possibly a single drum or barrel, is desired which would be less costly then a larger unit and also take less space in a commercial environment.

Figure 1:
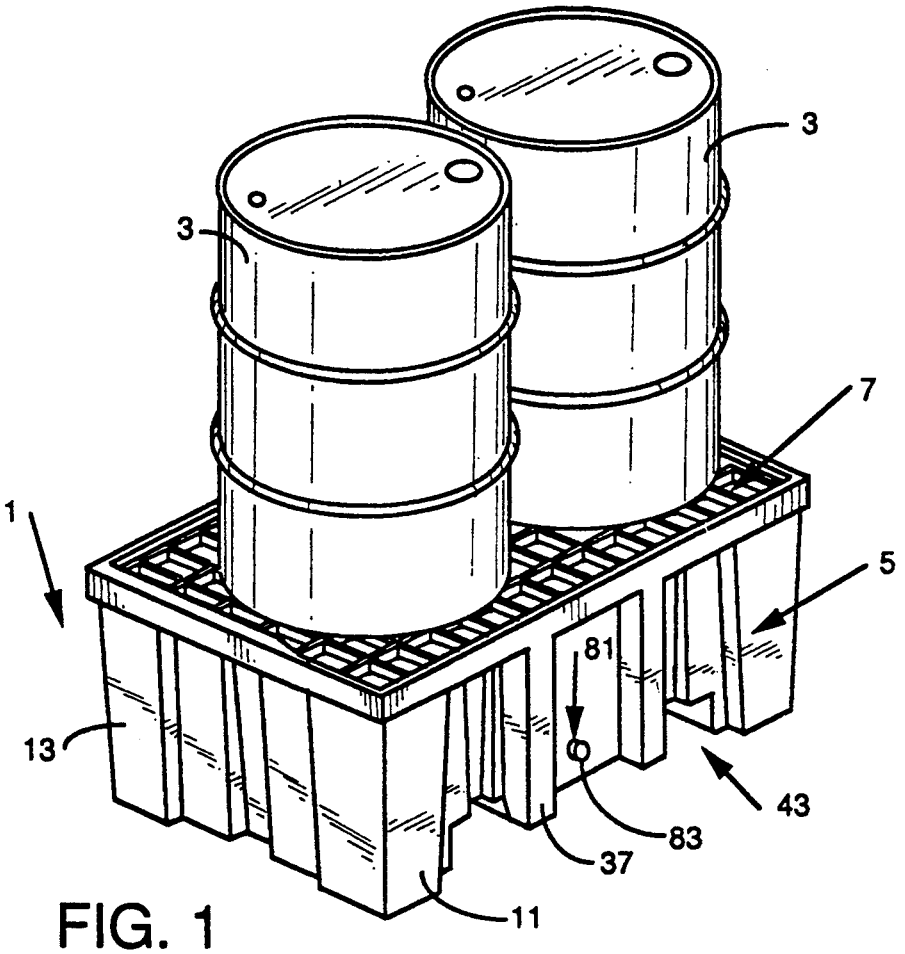
FIG. 1 is a perspective view of an embodiment of the two drum hazardous material spill skid of the present invention showing two barrels supported thereon.
Figure 2:
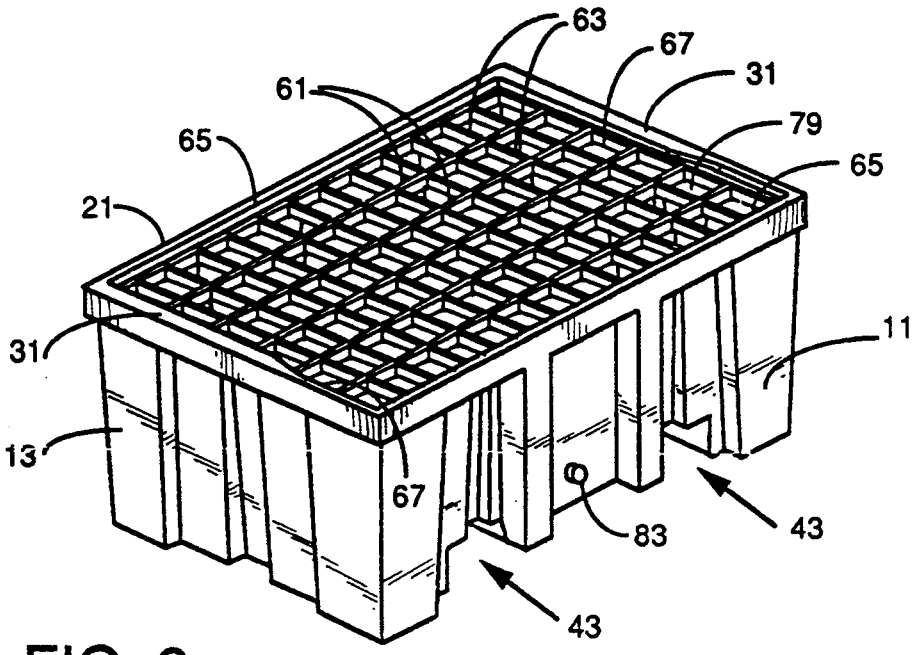
FIG. 2 is a perspective view similar to FIG. 1 with the drums removed.
Figure 3:
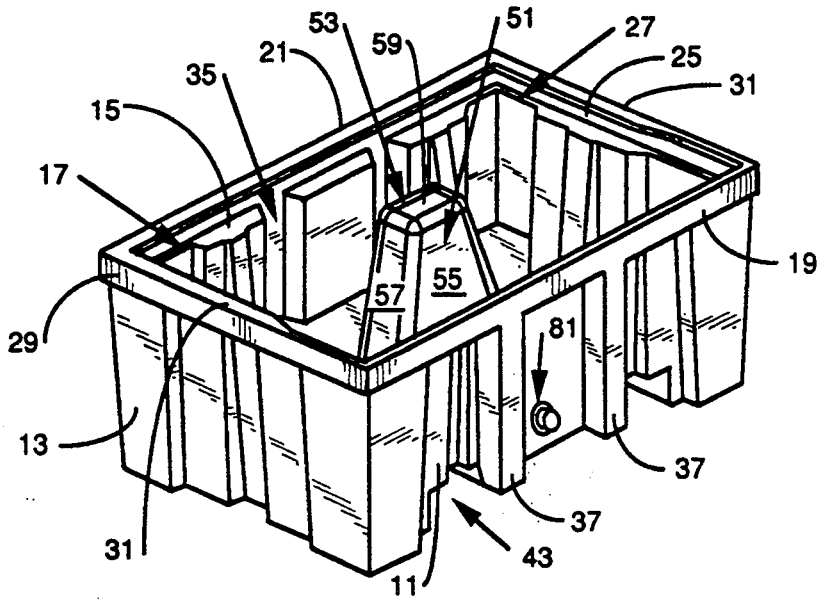
FIG. 3 is a top isometric view of the rectangular tray of the two drum hazardous material spill skid illustrated in FIG. 1.
Figure 4:
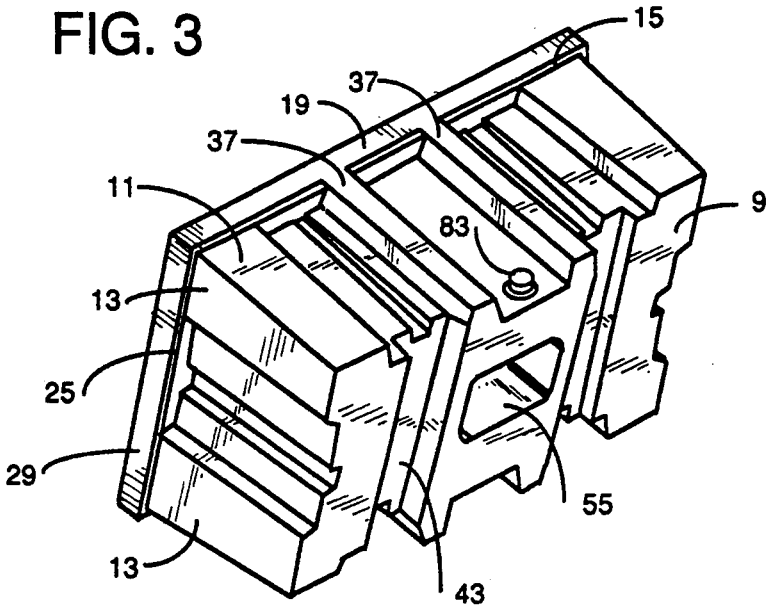
FIG. 4 is a bottom isometric view of the rectangular tray of the two drum hazardous material spill skid illustrated in FIG. 1.
Figure 5:
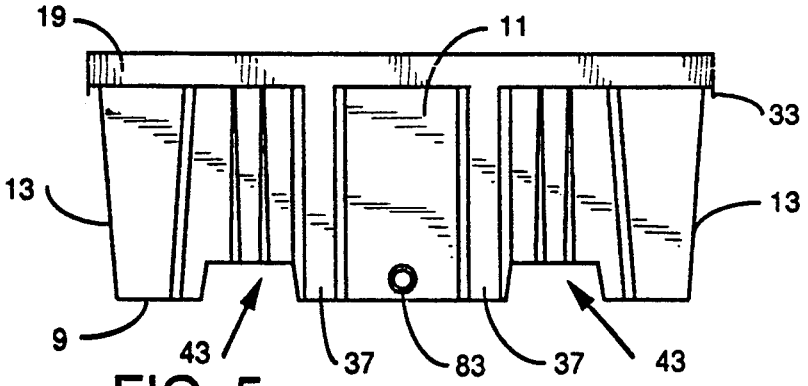
FIG. 5 is a side elevational view of the rectangular tray of the two drum hazardous material spill skid illustrated in FIG. 1.
Figure 6:
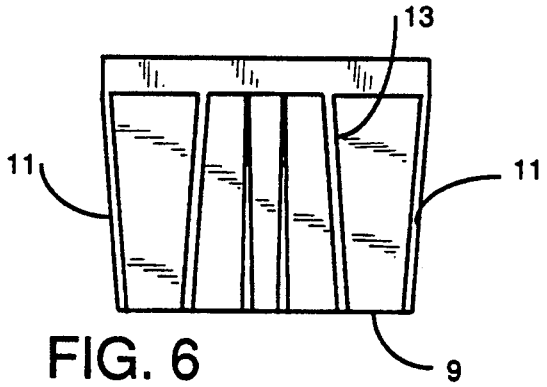
FIG. 6 is an end elevational view of the rectangular tray of the two drum hazardous material spill skid illustrated in FIG. 1.
Figure 7:
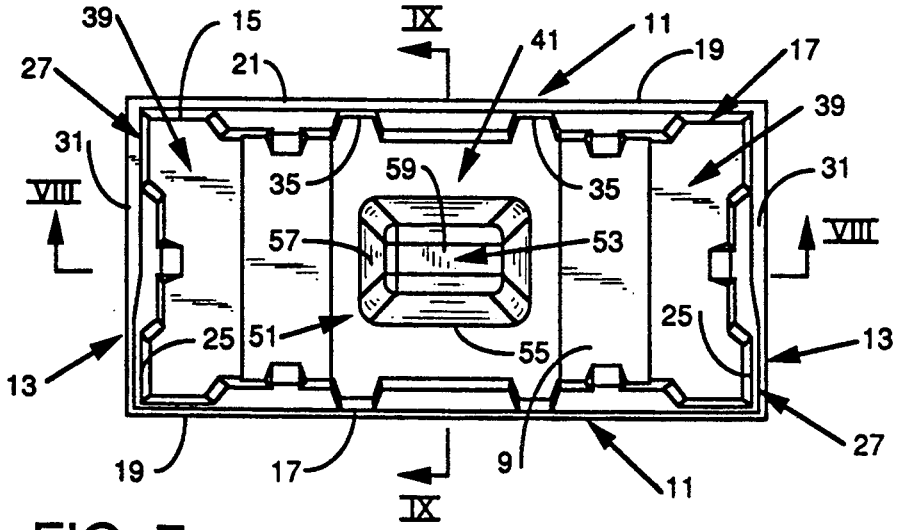
FIG. 7 is a top plan view of the rectangular tray of the two drum hazardous material spill skid illustrated in FIG. 1.

The two barrel hazardous waste spill skid of the present invention is illustrated in the drawings. Referring now to the drawings, FIG. 1 illustrates an embodiment of the two drum hazardous waste spill skid 1 with two commercial barrels or drums 3 supported thereon, the two barrel hazardous spill skid 1 comprising a rectangular tray 5 and a grate 7.

The rectangular tray 5, as best shown by reference to FIGS. 3–10, has a bottom wall 9, a pair of opposed side walls 11, which extend upwardly and outwardly from the bottom wall 9, and a pair of opposed end walls 13, of a shorter length then the side walls 11, which also extend upwardly and outwardly from the bottom wall 9. Each side wall 11 terminates in a horizontally outwardly extending flange 15, that has an upper surface 17, with a vertically upwardly extending rim 19. On one of the side walls 11, a side locking lip 21 extends inwardly from the upper edge of the rim 19. A downwardly depending leg 23 is provided at the outer end of the flange 15. Each end wall 13 terminates as a horizontally outwardly extending flange 25, that has an upper surface 27, with a vertically upwardly extending rim 29. Each of the end walls 13 has an end locking lip 31 which extends inwardly from the upper edge of the rim 29 from a location adjacent the central portion of the end wall 13 to the side locking lip 21 of the side wall 11. A downwardly depending leg 33 is provided at the outer end of the flange 25. The upper surfaces 17 and 27 of horizontal flanges 15 and 25 lie in a substantially horizontal plane spaced from the bottom wall 9. A plurality of outwardly directed recesses 35 are provided in the side walls 11, with the outer wall 37 of said recesses merging with the rim 19 of said side wall 11. The recesses 35 extend from the bottom wall upwardly through horizontal flange 15. The recesses 35 in the side walls 11 form strengthening ribs therefor. A downwardly extending rectangular recess 39 is formed in the bottom wall 9 adjacent each end wall 13 which extends between the side walls 11, and a central recess 41 is also provided between the side walls 11. Between the central recess 41 and the two rectangular recesses 39 are formed fork lift channels 43.

In the center of the bottom wall 9 of the tray 5 is an upwardly extending hollow center support post 51, which has an upper surface 53 that lies in a horizontal plane substantially the same as a horizontal plane formed by upper surfaces 17 and 27 of the horizontally outwardly extending flange 15 and 25 on the side walls 11 and end walls 13 of the tray 5. The center support post 51 is preferably in the shape of a truncated cone having side walls 55, end walls 57 and top wall 59 having the upper surface 53.

Figure 11:
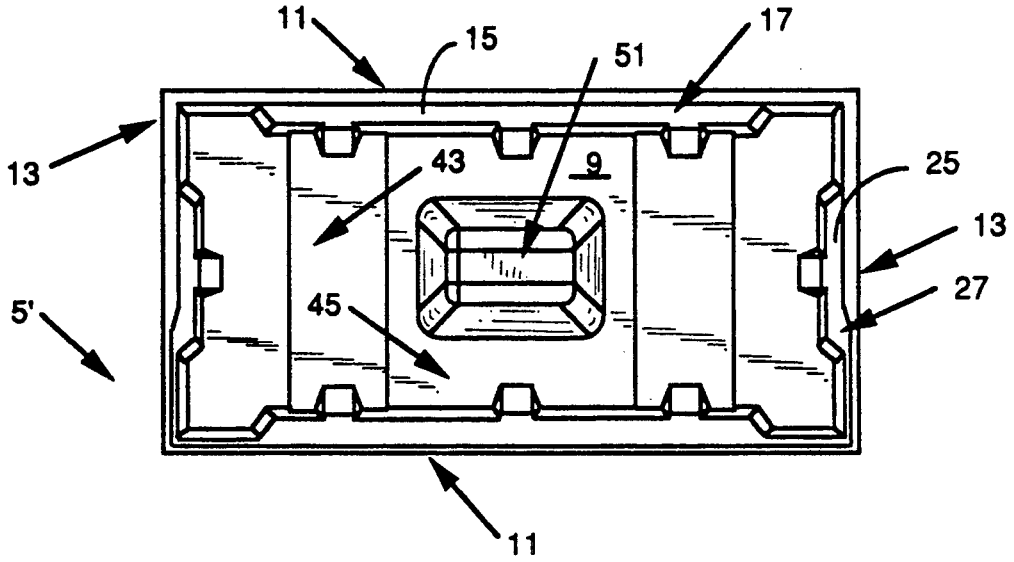
FIG. 11 is a top plan view of an alternate embodiment of the tray portion of the hazardous material spill skid of the present invention.
Figure 12:
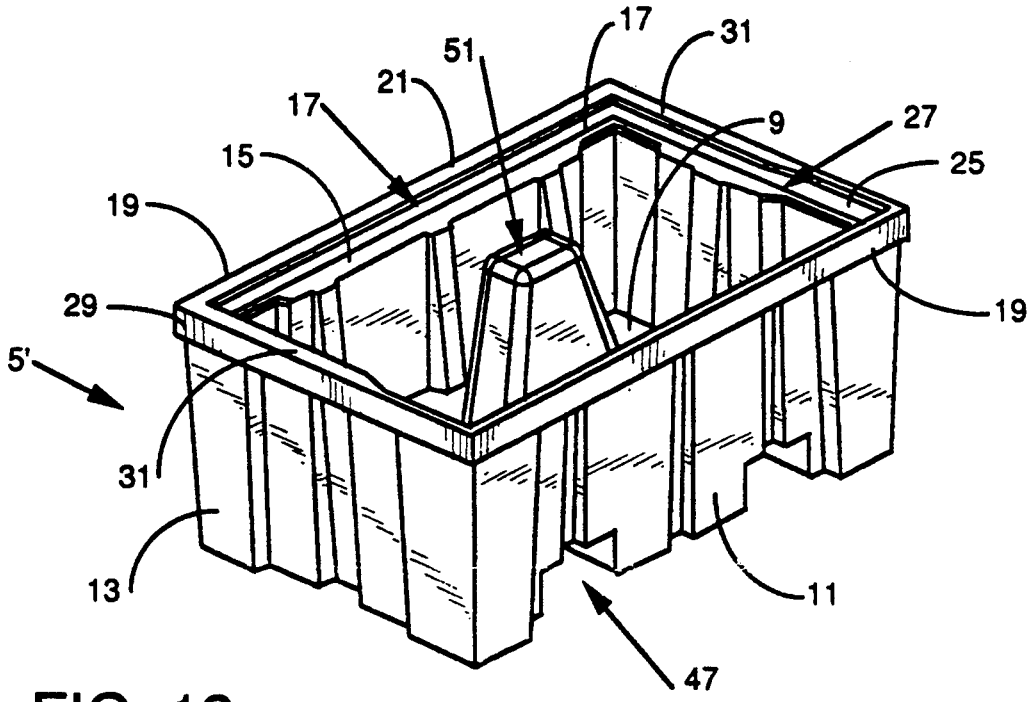
FIG. 12 is a top isometric view of the tray illustrated in FIG. 11.

In the embodiment of the tray 5′ illustrated in FIGS. 11 and 12, the tray has components the same as in tray 5, except that no outwardly directed recesses 35 are formed in the side walls 11. This arrangement provides additional upper surface area on upper surface 17 of outwardly extending flanges 15 for support of a grate 7.

Figure 8:
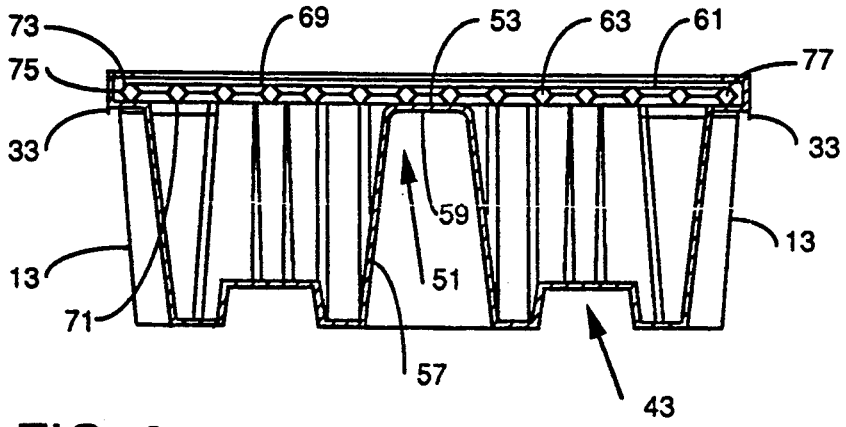
FIG. 8 is a cross-sectional view taken along lines VIII—VIII of FIG. 7 with a grate positioned on the tray.
Figure 9:
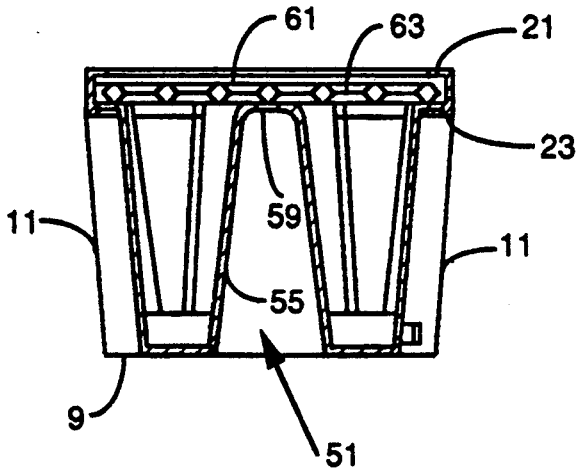
FIG. 9 is a cross-sectional view taken along lines IX—IX of FIG. 7 with a grate positioned on the tray.
Figure 10:
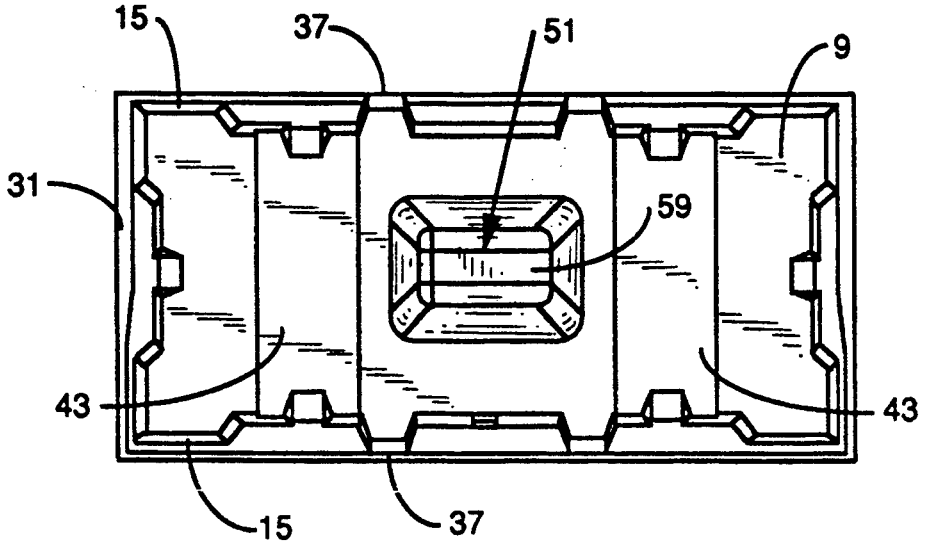
FIG. 10 is a bottom plan view of the rectangular tray of the two drum hazardous material spill skid illustrated in FIG. 1.

The grate 7 that is used in the two barrel hazardous material spill skid 1 of the present invention preferably comprises a plurality of spaced parallel bars 61 interconnected by a plurality of spaced cross-bars 63, which are preferably parallel to each other, that are disposed between opposed spaced side bars 65 and end opposed spaced end bars 67, the side and end bars 65 and 67 forming a rectangular frame. Each of the parallel bars 61, cross-bars 63, side bars 65 and end bars 67 are preferably hollow elements, and the parallel bars 63 and 65 have an upper wall 69, lower wall 71 and outwardly extending side walls 73 extending from each of the upper and lower walls 69, 71 to meet at a connecting line 75. The grate 7 is preferably blow molded and has hollow chambers 77 in the bars (FIG. 8). Drainage openings 79 are provided in the grate 7.

In order to assemble the grate 7 on the tray 5, the grate 7 is positioned with a side bar 65 substantially parallel to a side wall 11 of the tray and is placed on upper surfaces 27 the two flanges 25 of the end walls 13. The grate 7 is then moved towards the side wall 11 having the side locking lip 21 and slid underneath the end locking lips 31 and the side locking lip 21 and dropped onto the upper surface 17 of the opposed side wall 11. The side locking lip 21 and end locking lip 31 will retain the grate 7 on the tray, but the grate 7 can, when desired, be removed therefrom by reversing the aforementioned procedure.

The downwardly depending legs 23 and 33 on flanges 15 and 25 are provided so as to permit engagement therewith of hold-down straps (not shown) for barrels 3 when the barrels are placed on the grate 7 of the hazardous material spill skid. A drain hole 81 may be provided in one of the side or end walls and a drain hole plug 83 provided to seal the drain hole until it is necessary to drain the contents of the tray 5.

What is claimed is:

1. A two barrel hazardous material spill skid comprising:

a rectangular tray comprising a bottom wall, opposed side walls extending upwardly and outwardly from said bottom wall and opposed end walls, of a shorter length than said side walls, extending upwardly and outwardly from said bottom wall, at least a portion of each said side wall and end wall terminating as a horizontally outwardly extending flange having an upper surface, with a vertically upwardly extending rim disposed about the upper ends of said side and end walls;

a side locking lip on one of said side walls extending inwardly from the upper edge of said rim, and an end locking lip on each of said end walls extending inwardly from the upper edge of said rim, each said end locking lip extending from a location adjacent a central portion of the respective end wall to the side locking lip of said side wall;

a hollow center post extending upwardly from said bottom wall, said hollow center post having an upper surface in a horizontal plane formed by said upper surface of said horizontally extending flanges; and a grate resting on said horizontally outwardly extending flanges of said side walls, on said horizontally outwardly extending flanges of said end walls, and the upper surface of said hollow center post of said bottom wall, to provide a support surface for barrels placed on said grate.

2. The two barrel hazardous material spill skid as defined in claim 1 wherein a plurality of outwardly extending recesses, having an outer wall, are provided in the side walls, the outer wall of said recesses merging with the vertically upwardly extending rim of said side walls.

3. The two barrel hazardous material spill skid as defined in claim 1 wherein said hollow center post is in the shape of a truncated cone.

4. The two barrel hazardous material spill skid as defined in claim 1 including a downwardly extending rectangular recess formed in said bottom wall adjacent each end wall and a central recess formed in said bottom wall to form fork lift channels therein.

5. The two barrel hazardous material spill skid as defined in claim 1 wherein said grate comprises a blow molded unit having a plurality of bars interconnected by spaced cross-bars, each said bar and cross-bar being hollow.

6. The two barrel hazardous material spill skid as defined in claim 5 wherein said grate has hollow side and end bars forming a rectangular frame, said plurality of bars are parallel to each other, said plurality of cross-bars are parallel to each other, and said bars and cross-bars are disposed between said hollow side and end bars.

7. The two barrel hazardous material spill skid as defined in claim 6 wherein each of said parallel bars and cross-bars are hollow elements having an upper wall, lower wall, and outwardly extending side walls which meet at a connecting line.

8. A two barrel hazardous material spill skid comprising:

a rectangular tray comprising a bottom wall, opposed side walls extending upwardly and outwardly from said bottom wall and opposed end walls, of a shorter length than said side walls, extending upwardly and outwardly from said bottom wall, at least a portion of each said side wall and end wall terminating as a horizontally outwardly extending flange having an upper surface, with a vertically upwardly extending rim disposed about the upper ends of said side and end walls;

a side locking lip on one of said side walls extending inwardly from the upper edge of said rim, and a pair of end locking lips, one on each of said opposed end walls, extending inwardly from the upper edge of said rim;

a hollow center post, in the shape of a truncated cone, extending upwardly from said bottom wall, said hollow center post having an upper surface in a horizontal plane formed by said upper surface of said horizontally extending flanges; and a grate resting on said horizontally outwardly extending flanges of said side walls, on said horizontally outwardly extending flanges of said end walls, and the upper surface of said hollow center post of said bottom wall, to provide a support surface for barrels placed on said grate secured thereto by said side locking lip and said end locking lips.

9. The two barrel hazardous material spill skid as defined in claim 8 wherein said end locking lips extend from a location adjacent a central portion of a respective end wall to the side locking lip of said one of said side walls.

10. The two barrel hazardous material spill skid as defined in claim 8 wherein said grate comprises a blow molded unit having a plurality of bars interconnected by spaced cross-bars, each said bar and cross-bar being hollow.

* * * * *